US008181950B2

(12) United States Patent
Kato et al.

(10) Patent No.: US 8,181,950 B2
(45) Date of Patent: May 22, 2012

(54) SHEET PROCESSING APPARATUS HAVING PUNCHING UNIT

(75) Inventors: Hitoshi Kato, Toride (JP); Naoki Ishikawa, Kashiwa (JP); Yasuo Fukatsu, Abiko (JP)

(73) Assignee: Canon Kabushiki Kaisha (JP)

( * ) Notice: Subject to any disclaimer, the term of this patent is extended or adjusted under 35 U.S.C. 154(b) by 64 days.

(21) Appl. No.: 12/910,233

(22) Filed: Oct. 22, 2010

(65) Prior Publication Data

US 2011/0100187 A1 May 5, 2011

(30) Foreign Application Priority Data

Nov. 4, 2009 (JP) ..... 2009-253017

(51) Int. Cl.
*B26D 5/00* (2006.01)

(52) U.S. Cl. ..... 270/58.07

(58) Field of Classification Search ..... 270/58.07, 270/58.17; 83/563, 732
See application file for complete search history.

(56) References Cited

U.S. PATENT DOCUMENTS

| | | | | |
|---|---|---|---|---|
| 6,065,383 | A * | 5/2000 | Takaishi et al. | 83/368 |
| 6,702,279 | B2 * | 3/2004 | Adachi et al. | 271/220 |
| 7,520,497 | B2 * | 4/2009 | Moriyama et al. | 270/58.07 |
| 2010/0189487 | A1 * | 7/2010 | Iwata | 399/407 |

FOREIGN PATENT DOCUMENTS

JP 2007-076775 A 3/2007

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus that allows to accelerate a punching process while executing a sheet ejection offset certainly. A conveying unit conveys a sheet. A first moving unit moves the sheet conveyed by the conveying unit in a width direction that crosses a conveying direction of the sheet. A punching unit punches a hole in the sheet. A second moving unit moves the punching unit in the width direction. A control unit controls the first moving unit so as to change positions of sheets ejected to a sheet stack unit in the width direction by turns for every sheet bundle sorted. The control unit controls the second moving unit and the punching unit so as to execute a punching operation by the punching unit while moving the punching unit in synchronization with the movement of the sheet by the first moving unit.

4 Claims, 12 Drawing Sheets

SHEET PROCESSING APPARATUS HAVING PUNCHING UNIT

BACKGROUND OF THE INVENTION

1. Field of the Invention

The present invention relates to a sheet processing apparatus having a punching unit that punches a hole in a sheet outputted from an image forming apparatus such as a copier or a laser beam printer.

2. Description of the Related Art

A conventional sheet processing apparatus punches a hole in a recording sheet, on which an image is formed, one by one during conveyance (for example, see Japanese Laid-Open Patent Publication (Kokai) No. 2007-76775 (JP 2007-76775A)).

FIG. 10 is a sectional view of the above-mentioned conventional sheet processing apparatus. As shown in FIG. 10, the conventional sheet processing apparatus 1*a* is connected to a sheet ejection side of an image forming apparatus 300 that forms an image on a sheet. The sheet processing apparatus 1*a* is provided with a punching device 50 that punches a hole in a sheet on which an image is formed by the image forming apparatus 300 and that is conveyed.

FIG. 11 is a schematic view showing the punching device 50 in FIG. 10 when it is viewed from the right side, i.e., the side of the image forming apparatus 300. As shown in FIG. 11, the punching device 50 is provided with an entrance sensor 31, a punching unit 51, and a shift unit 42 that are arranged in a conveying direction of a sheet. Further, the punching device 50 is provided with a conveying motor M1, a sensor-moving motor M3, and a shift-roller-moving motor M2.

The conveying motor M1 rotates a shift roller pair 4 through a broad gear 40, and rotates a shift roller pair 3 connected by a timing belt 41. These shift roller pairs 3 and 4 are mounted on the shift unit 42. The shift unit 42 is shifted in directions of arrows A and B by the shift-roller-moving motor M2.

A position of a sheet under conveyance in a width direction is detected by a lateral registration detection sensor 32 arranged between the shift roller pair 3 and the shift roller pair 4. The lateral registration detection sensor 32 is mounted on a sensor unit 33. The sensor unit 33 is moved in directions of arrows 43 and 44 by the sensor-moving motor M3.

FIG. 12 is a timing chart showing a punching operation by the punching device 50. Time advances to right from left in the figure.

FIG. 12 shows driving signals of the conveying motor M1, the sensor-moving motor M3, the shift-roller-moving motor M2, and the punching motor (not shown), respectively. In each driving signal, a high (H) level means that a corresponding motor is under operation, and a low (L) level means that it is not under operation.

First, the sensor-moving motor M3 is operated so that the sensor 32 moves in a direction (referred to as a "width direction", hereinafter) that crosses the conveying direction of a sheet (an operating section 70) at a timing when the lateral registration detection sensor 32 detects a front edge of the sheet conveyed from the image forming apparatus 300. A position of the sheet in the width direction is detected based on a moving distance of the sensor 32 between the start of moving and the detection of the sheet. Next, the shift-roller-moving motor M2 is operated to move the sheet to a predetermined position in the width direction so as to punch a hole at an aimed position in the sheet (an operating section 66). And when a rear edge of the sheet reaches a punching position, the sheet is stopped, and the punching motor is operated to punch a hole in the sheet (an operating section 71). When stacking the punched sheets on the stack tray 201, stacked positions of respective groups of the sheets are changed in order to clarify boundaries among the groups (an operating section 65). Thus, the change of the stacked positions to clarify the boundaries among the groups is hereafter called a "sheet ejection offset".

When the rear edge of the sheet passes the shift roller pair 4, the shift-roller-moving motor M2 is operated so that the shift roller pairs 3 and 4 are moved to standby positions for the next sheet (an operating section 72). The operations described above are a series of punching operations.

It should be noted that the front edge of the sheet reaches the shift roller pair 3 at a timing 68 in FIG. 12. The shift roller pairs 3 and 4 return to the standby positions at a timing 69. Therefore, a punching process time is defined as a period (a section 67) from the time when the front edge of the sheet reaches the shift roller pair 3 to the time when the shift roller pairs 3 and 4 return to the standby positions after the rear edge of the sheet passes the shift roller pair 4.

Thus, the above-mentioned conventional sheet processing apparatus achieves downsizing and cost reduction of the device by arranging the punching unit 51 near the shift roller pair 3 and by using the same mechanism for moving the sheet to adjust the sheet to the punching position and for moving the sheet for the sheet ejection offset.

Incidentally, the sheet processing apparatus including the punching unit is required to increase the speed of the punching process in order to create a lot of products in a short time. The shorter the punching process time is, the higher the speed of the punching process is. In order to shorten the punching process time, it is effective to return the shift roller pairs to the standby positions quickly after punching. In order to return the shift roller pairs to the standby positions quickly, it is necessary to shorten a period until the rear edge of the sheet passes the shift roller pair after finishing the punching (referred to as a "shift conveying time", hereinafter). In order to shorten the shift conveying time, a method to increase the sheet conveying speed of the sheet after punching, a method to reduce the number of shift roller pairs from two pairs to one pair, etc. can be considered, for example.

When either of the above-described methods is executed, the timing when the rear edge of the sheet passes the shift roller pair 4 is changed to a position 74 from a position 73 in the timing chart in FIG. 12. As a result, in the above-mentioned conventional sheet processing apparatus, the rear edge of the sheet passes the shift roller pair 4 before the sheet ejection offset (the operating section 65 in FIG. 12) is completed. This causes a problem that the movement of the sheet by the shift roller pairs 3 and 4 in the width direction for the sheet ejection offset becomes insufficient.

SUMMARY OF THE INVENTION

The present invention provides a sheet processing apparatus that allows to accelerate a punching process while executing a sheet ejection offset certainly.

Accordingly, an aspect of the present invention provides a sheet processing apparatus provided with a punching unit, comprising a conveying unit configured to convey a sheet, a first moving unit configured to move the sheet conveyed by the conveying unit in a width direction that crosses a conveying direction of the sheet, a punching unit configured to punch a hole in the sheet, a second moving unit configured to move the punching unit in the width direction, and a control unit configured to control the first moving unit so as to change positions of sheets ejected to a sheet stack unit in the width direction by turns for every sheet bundle sorted, and to control the second moving unit and the punching unit so as to execute a punching operation by the punching unit while moving the punching unit in synchronization with the movement of the sheet by the first moving unit.

According to the present invention, since the sheet ejection offset is executed during the punching operation to the sheet, the sheet ejection offset can be started before conveying the sheet after punching. This enables to accelerate the sheet conveying speed. And therefore, even when there is only one shift roller pair, the sheet ejection offset can be completed before the rear edge of the sheet passes the shift roller pair. As a result, the shift roller pair can be quickly returned to a standby position, and the punching process time can be shortened.

Since the punching unit returns to the standby position at the time when the punching operation finishes, a moving range of the punching unit can be narrowed and the moving mechanism of the punching unit can be miniaturized.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
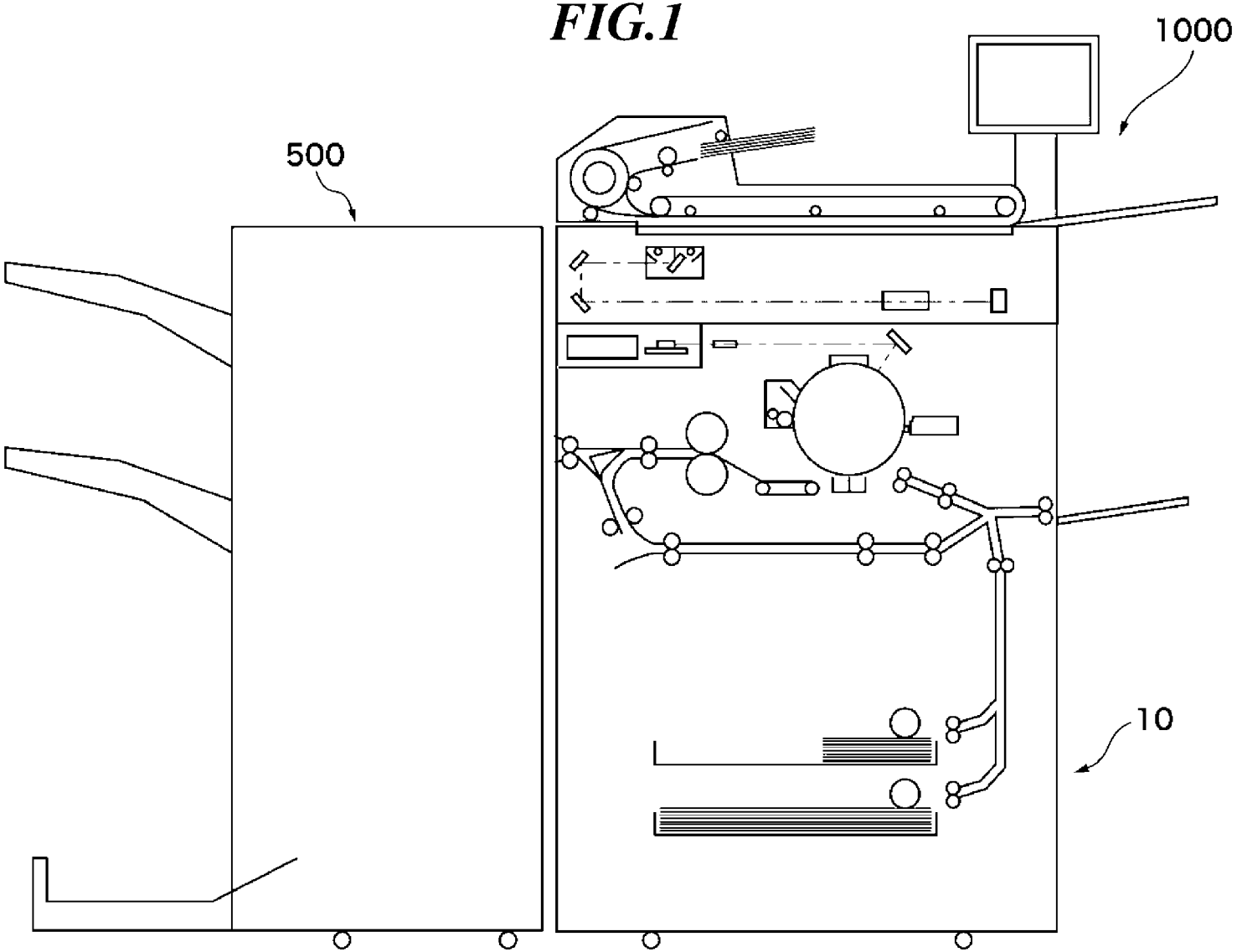
FIG. 1 is a sectional view showing an image forming system including a sheet processing apparatus according to an embodiment of the present invention.

FIG. 1 is a sectional view showing an image forming system 1000 including a sheet processing apparatus 500 according to an embodiment of the present invention.

As shown in FIG. 1, the image forming system 1000 consists of an image forming apparatus 10 and the sheet processing apparatus 500, which is connected to a sheet ejection side the image forming apparatus 10.

Figure 2:
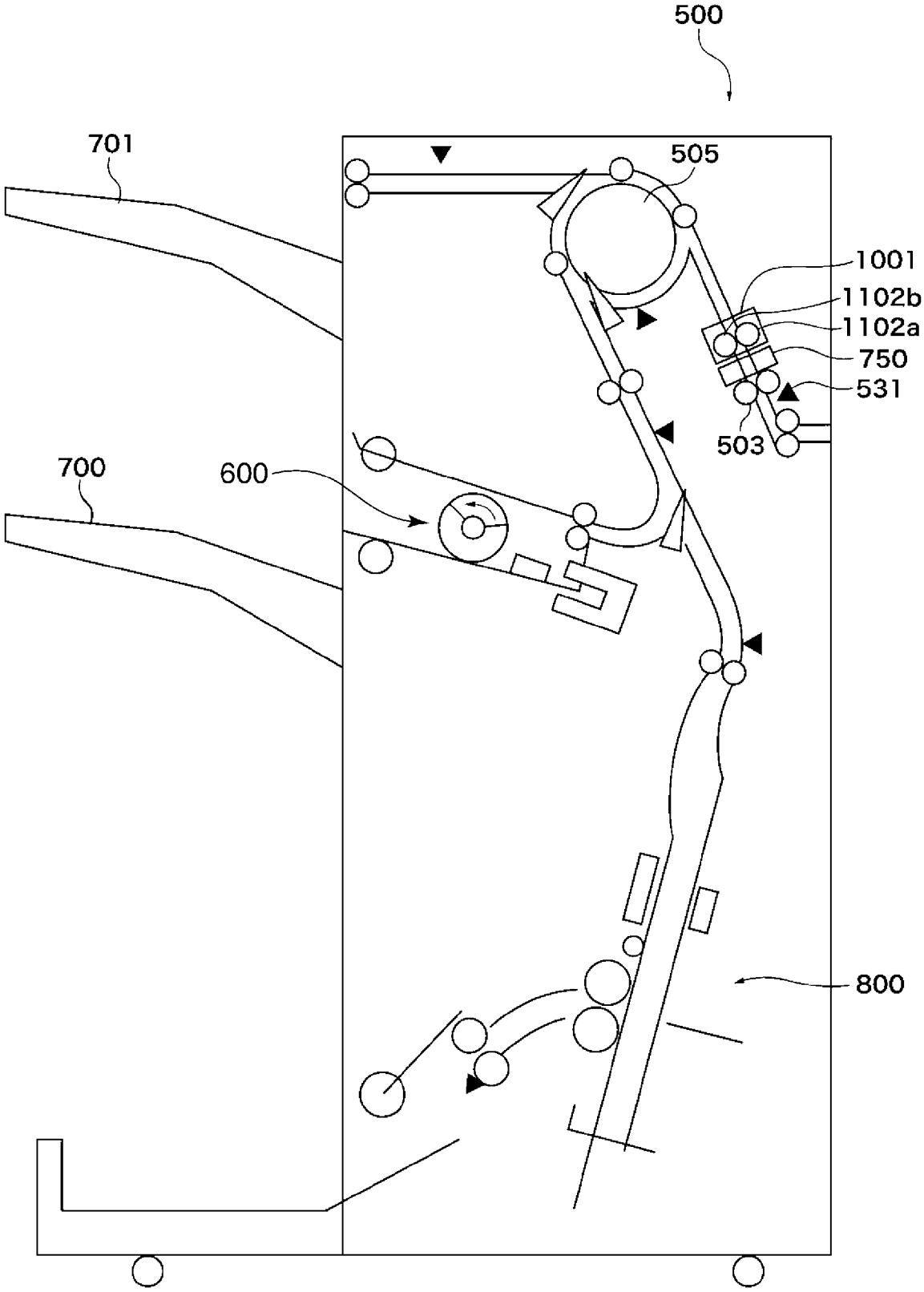
FIG. 2 is a sectional view showing the sheet processing apparatus in FIG. 1.

FIG. 2 is a sectional view of the sheet processing apparatus 500. As shown in FIG. 2, the sheet processing apparatus 500 executes various processes including: a process of taking in sheets conveyed from the image forming apparatus 10, a process of adjusting and bundling a plurality of taken-in sheets, a sorting process, a non-sorting process, a staple process (a stitch process) of stapling a rear end of a sheet bundle, a punching process of punching a punch hole in the rear end of a sheet, a bookbinding process, etc. The sheet processing apparatus 500 is provided with a punching unit 750 that punches a punch hole in a sheet, a staple unit 600 that staples a sheet bundle, and a bindery unit 800 that binds a book by folding the sheet bundle into two leaves.

A lateral registration shift unit 1001, which conveys a sheet while shifting it in a direction (referred to as a "width direction" hereinafter) that crosses the conveying direction for the sheet ejection offset, and which conveys a sheet while moving it to a predetermined position in the width direction, is mounted between a conveying roller pair 503 and a buffer roller 505. A sheet is moved in the width direction when a punch mode to punch a hole in a sheet is selected. The sheet processing apparatus 500 is provided with trays 700 and 701 that are sheet stacking means to stack sheets processed normally.

Figure 3:
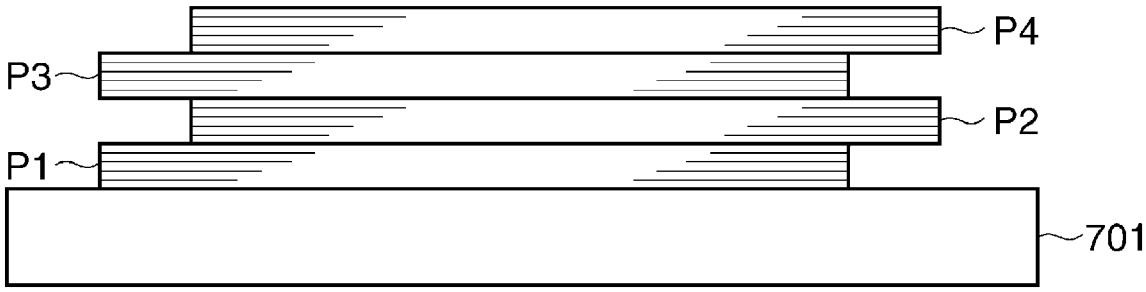
FIG. 3 is a view showing an example of sheet bundles stacked on a stack tray in FIG. 2 after the sheet ejection offset.

FIG. 3 is a view showing an example of sheet bundles stacked on the stack tray 701 after the sheet ejection offset. FIG. 3 shows the stack tray 701 viewed from a left side in FIG. 2. As shown in FIG. 3, a plurality of sheet bundles P1 through P4 are sorted and stacked under the condition that positions in the width direction differ by turns, respectively.

Figure 4:
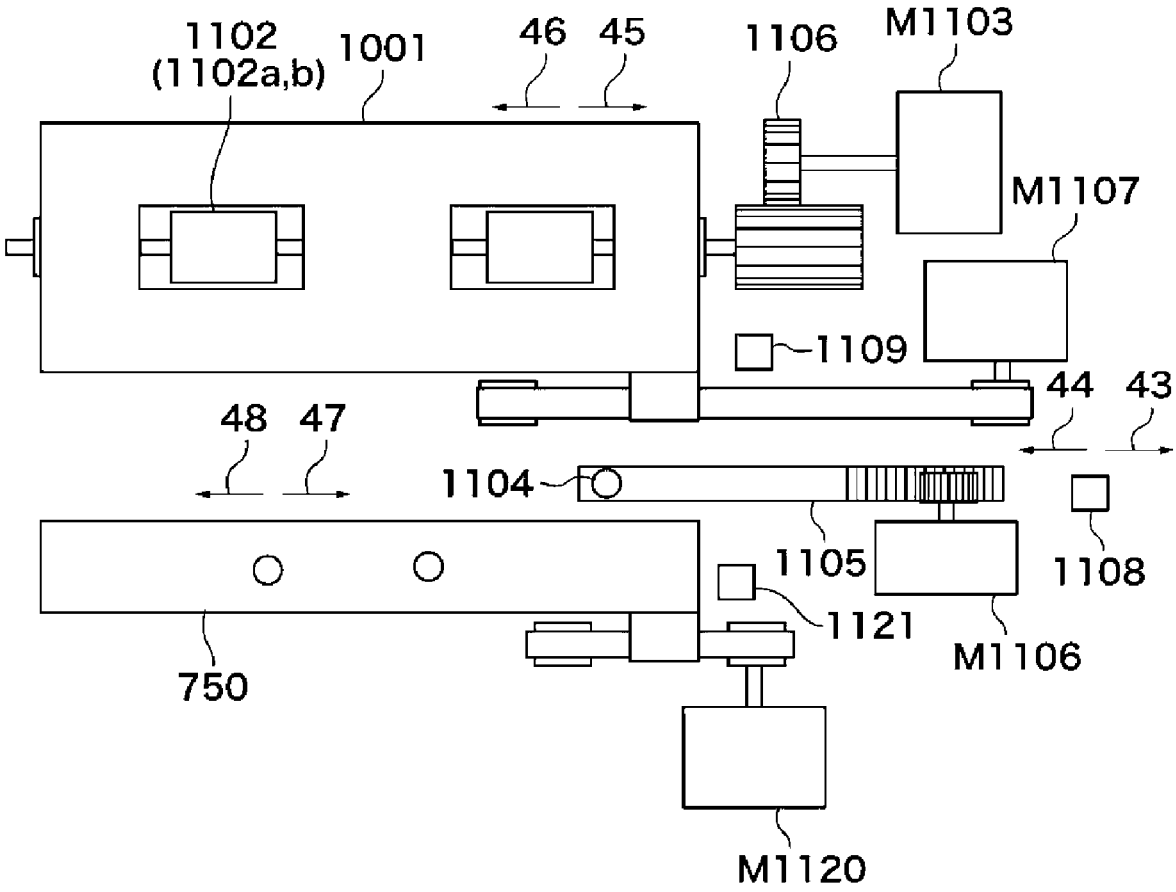
FIG. 4 is a view schematically showing configurations of a lateral registration shift unit and a punching unit in FIG. 2.

FIG. 4 is a view schematically showing configurations of the lateral registration shift unit 1001 and the punching unit 750.

In FIG. 4, a shift conveying motor M1103 moves the lateral registration shift unit 1001 that conveys a sheet while moving it in the width direction. The shift conveying motor M1103 drives a shift conveying roller 1102*a* via a gear 1106. Accordingly, the shift conveying roller 1102*a* collaborates with a driven roller 1102*b*, and conveys a sheet.

A position of sheet during conveyance in the width direction is detected by a lateral registration sensor 1104. The lateral registration sensor 1104 is mounted on a lateral registration sensor unit 1105 that moves in directions of arrows 44 and 43 by a lateral-registration-sensor-moving motor M1106. A home position that is a reference position of the lateral registration sensor unit 1105 is detected by an HP sensor 1108 for the lateral registration sensor unit.

A lateral registration shift motor M1107 moves the lateral registration shift unit 1001 that is separated from the lateral registration sensor unit 1105 in directions of arrows 45 and 46 (a first moving unit). A home position that is a reference position of the lateral registration shift unit 1001 is detected by an HP sensor 1109 for the lateral registration shift unit.

A punching-unit-moving motor M1120 moves the punching unit 750 in directions of arrows 47 and 48 (a second moving unit). A home position that is a reference position of the punching unit 750 is detected by an HP sensor 1121 for the punching unit.

Figure 5:
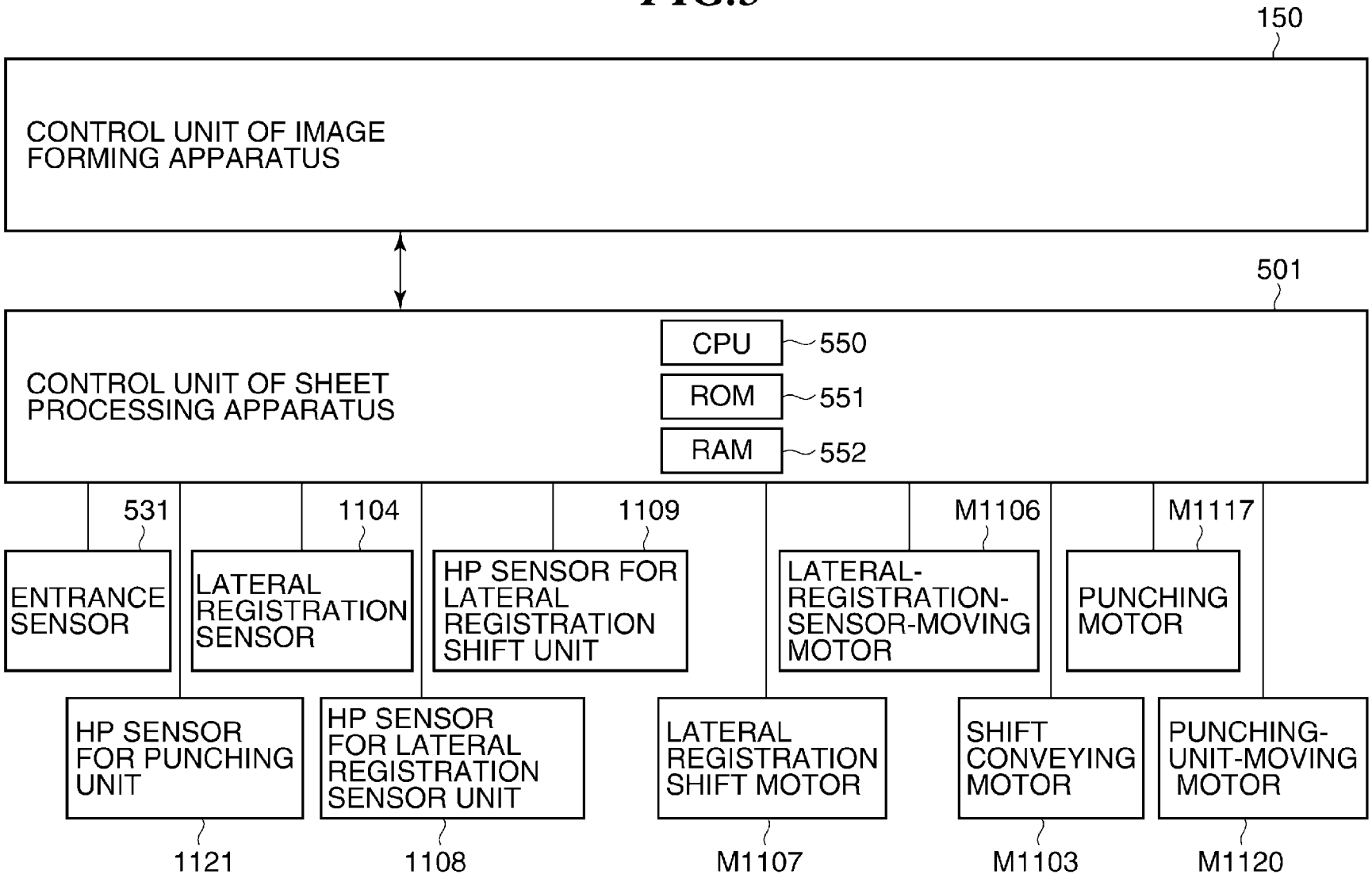
FIG. 5 is a block diagram schematically showing a control configuration of the sheet processing apparatus in FIG. 1.

FIG. 5 is a block diagram schematically showing a control configuration of the sheet processing apparatus 500. In FIG. 5, a control unit 501 is mounted, for example, on the sheet processing apparatus 500, and controls all the operations of the sheet processing apparatus 500 by exchanging information with a control unit 150 of the image forming apparatus 10. It should be noted that the control unit 501 may be mounted on the image forming apparatus 10 rather than the sheet processing apparatus 500.

The control unit 501 consists of a CPU 550, a ROM 551, a RAM 552, etc. The control unit 501 communicates with the control unit 150 of the image forming apparatus 10 via a communication IC (integrated circuit) that is not shown, and exchanges data. The control unit 501 executes various programs stored in the ROM 552 according to instructions from the control unit 150, and controls the operations of the sheet processing apparatus 500.

The control unit 501 controls the shift conveying motor M1103, the lateral-registration-sensor-moving motor M1106, the lateral registration shift motor M1107, the punching motor M1117, and the punching-unit-moving motor M1120 based on the detection results from an entrance sensor 531, the lateral registration sensor 1104, the HP sensor 1108 for the lateral registration sensor unit, the HP sensor 1109 for the lateral registration shift unit, and the HP sensor 1121 for the punching unit.

The control process executed by the sheet processing apparatus 500 configured as mentioned above will be described in detail with reference to FIG. 6 through FIG. 9.

Figure 6:
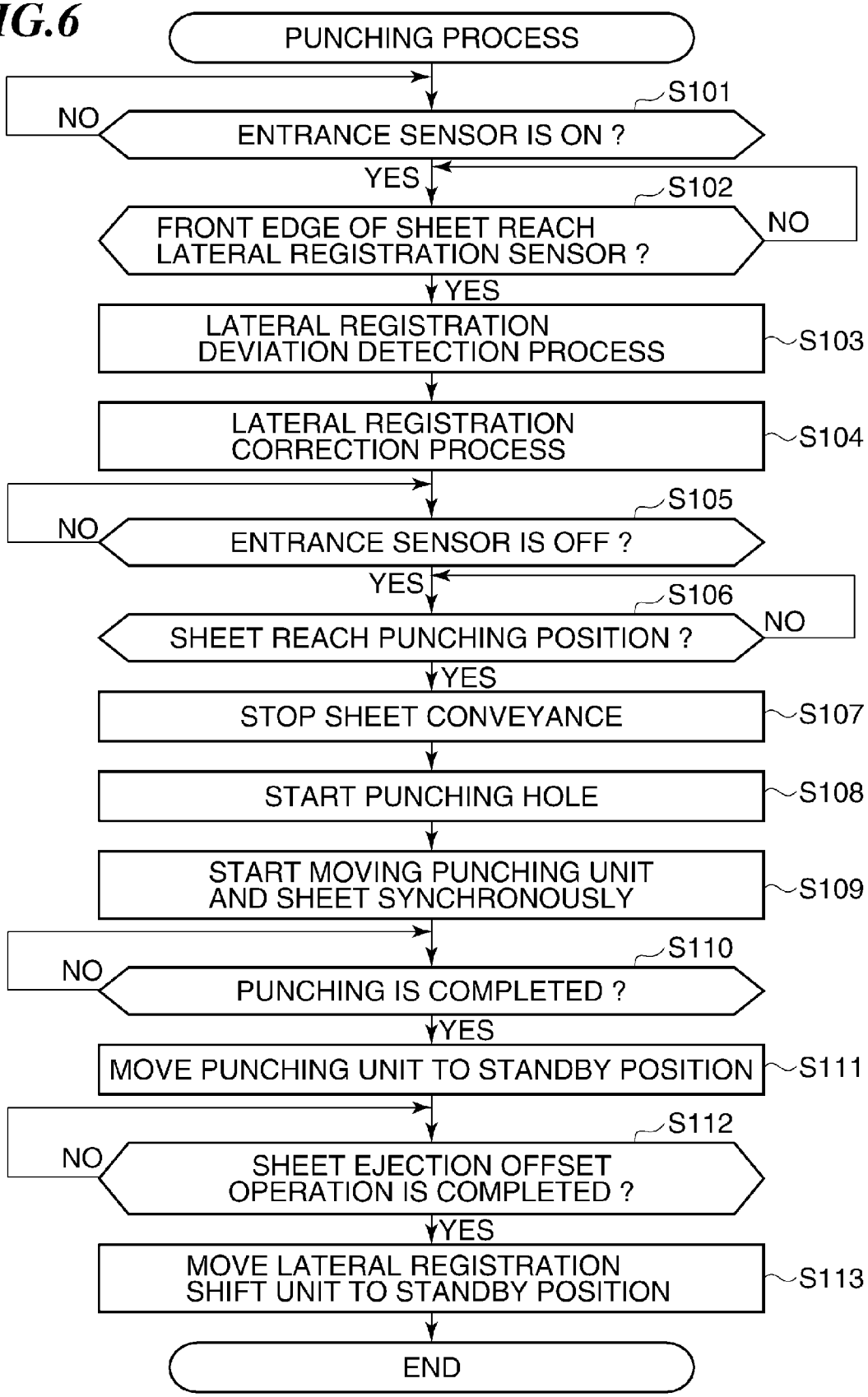
FIG. 6 is a flowchart showing a procedure of a punching process that the sheet processing apparatus in FIG. 1, especially a CPU of a control unit, executes.

FIG. 6 is a flowchart showing a procedure of a punching process that the sheet processing apparatus 500 in FIG. 1, especially the CPU 550 of the control unit 501, executes. The punching process is started according to an execution instruction of the punching process from the control unit 150 of the image forming apparatus 10.

In FIG. 6, the CPU 550 waits for the entrance sensor 531 to turn ON as a result of arrival of a sheet (step S101). When the entrance sensor 531 turns ON, the CPU 550 waits for the front edge of the sheet to reach the lateral registration sensor 1104 (step S102). Whether the front edge of the sheet reaches the lateral registration sensor 1104 is determined by the conveying distance of the sheet determined according to the operating time of a conveying motor (not shown) that drives the conveying roller pair 503 after the entrance sensor 531 turns on.

When the front edge of the sheet reaches the lateral registration sensor 1104, the CPU 550 executes a lateral registration deviation detection process (step S103). This lateral registration deviation detection process is executed to detect an edge position in the width direction of the sheet. Specifically, the CPU 550 moves the lateral registration sensor unit 1105 in the direction of the arrow 44 (see FIG. 4) from the home position. At the same time, the CPU 550 detects the position of the sheet edge in the width direction based on the moving distance of the lateral registration sensor 1104 that is determined according to the operating time of the lateral-registration-sensor-moving motor M1106 until the lateral registration sensor 1104 turns ON from the start of moving.

After the lateral registration deviation detection process is completed, the CPU 550 executes a lateral registration correction process (step S104) based on the detection result in the lateral registration deviation detection process. The lateral registration correction process is executed to correct the deviation of the sheet in the width direction. Specifically, the CPU 550 moves the sheet in the width direction by the lateral registration shift unit 1001 based on the position of the sheet in the width direction detected by the lateral registration deviation detection process, so as to adjust the sheet position to the punching unit 750.

Next, the CPU 550 waits for the entrance sensor 531 to turn OFF as the sheet passes (step S105). When the entrance sensor 531 turns OFF, the CPU 550 waits for the sheet to reach a punching position (step S106). The punching position is a position at which a hole is punched in the rear portion of the sheet. When the sheet reaches the punching position, the CPU 550 stops conveyance of the sheet in the conveying direction (step S107), and starts the punching operation (step S108). In conjunction with starting the punching operation, the CPU 550 starts moving the punching unit 750 and the sheet in the width direction at the same speed for the sheet ejection offset (step S109). This enables to execute the punching operation and the sheet ejection offset concurrently. That is, the punching operation to the sheet by the punching unit 750 is executed while moving the punching unit 750 in synchronization with the movement of the sheet.

Figure 7:
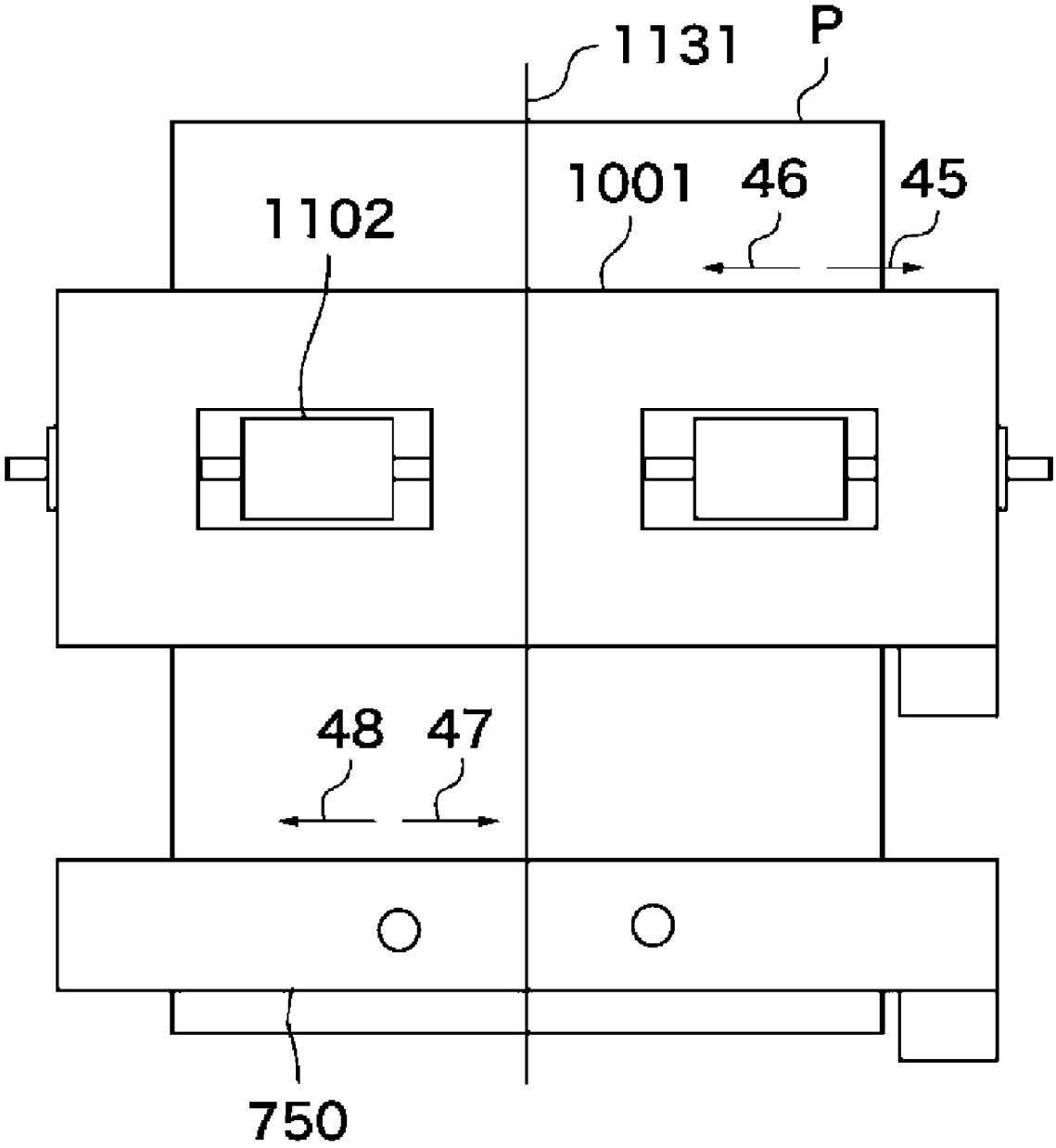
FIG. 7 is a view showing conditions of the lateral registration shift unit and the punching unit of the sheet processing apparatus in FIG. 1 before executing the sheet ejection offset.
Figure 8:
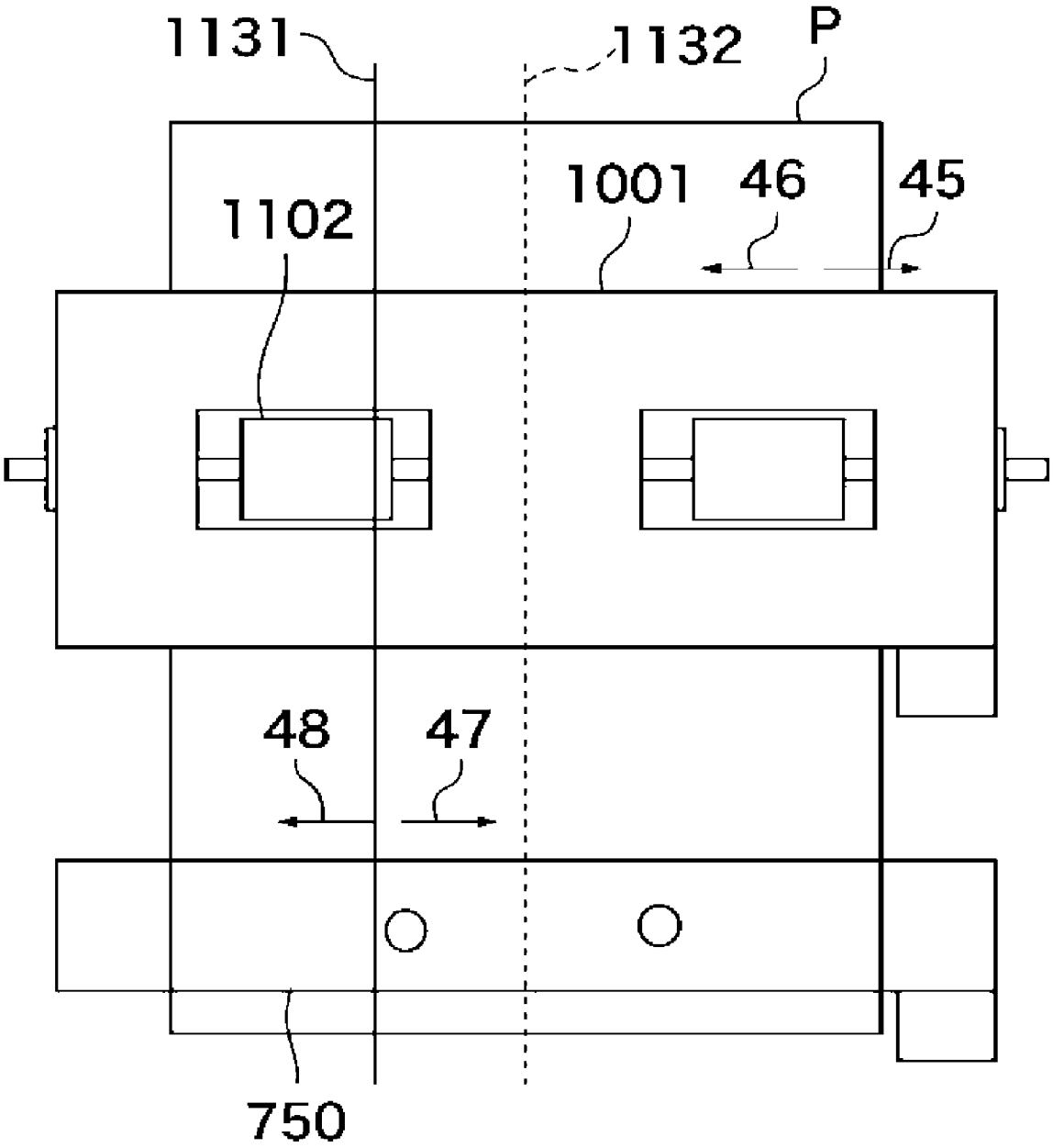
FIG. 8 is a view showing conditions of the lateral registration shift unit and the punching unit of the sheet processing apparatus in FIG. 1 when executing the sheet ejection offset to a back side in FIG. 1.

FIG. 7 is a view showing conditions of the lateral registration shift unit 1001 and the punching unit 750 before executing the sheet ejection offset. FIG. 8 is a view showing conditions of the lateral registration shift unit 1001 and the punching unit 750 when executing the sheet ejection offset in the back side (a right side in FIG. 8). A solid line 1131 in FIG. 7 and FIG. 8 shows the center of the conveyed sheet in the width direction. A dashed line 1132 shows the centers of the lateral registration shift unit 1001 and the punching unit 750 in the width direction.

That is, when the punching operation and the sheet ejection offset operation are executed concurrently, the center position of the conveyed sheet moves in the width direction from the solid line 1131 to the broken line 1132 in FIG. 8. FIG. 8 shows the example where the sheet ejection offset is executed to the back side. On the other hand, when the sheet ejection offset is executed to the front side, the lateral registration shift unit 1001 and the punching unit 750 are moved in the direction (the directions of the arrows 46 and 48) that is the reverse direction in the case where the sheet ejection offset is executed to the back side.

Returning to FIG. 6, the CPU 550 waits until the punching operation is completed (step S110). After the punching operation is completed, the CPU 550 moves the punching unit 750 to a standby position (step S111). Next, the CPU 550 waits until the movement of the sheet for the sheet ejection offset is completed (step S112). When the movement of the sheet for the sheet ejection offset is completed, the CPU 550 moves the lateral registration shift unit 1001 to the standby position (step S113), and finishes the punching process. The sheet to which the punching process has been applied is ejected to the stack tray 701.

The sorting process by the sheet ejection offset is executed to change the positions of the ejected sheets in the width direction by turns for every sheet bundle sorted. For example, when outputted forty sheets are sorted by dividing them into four bundles each of which includes ten sheets, as shown in FIG. 3, a first sheet bundle P1 including ten sheets of the beginning is ejected to a predetermined position, a second sheet bundle P2 including the next ten sheets is ejected to a position that is different from that of the first sheet bundle P1 in the width direction, and third and fourth sheet bundles P3 and P4 are shifted by turns so that the third and fourth sheet bundles P3 and P4 are ejected to the same positions as the first and second sheet bundles P1 and P2, respectively. Accordingly, the sheets are stacked on the stack tray 701 in the condition where the sheet bundles are sorted.

Figure 9:
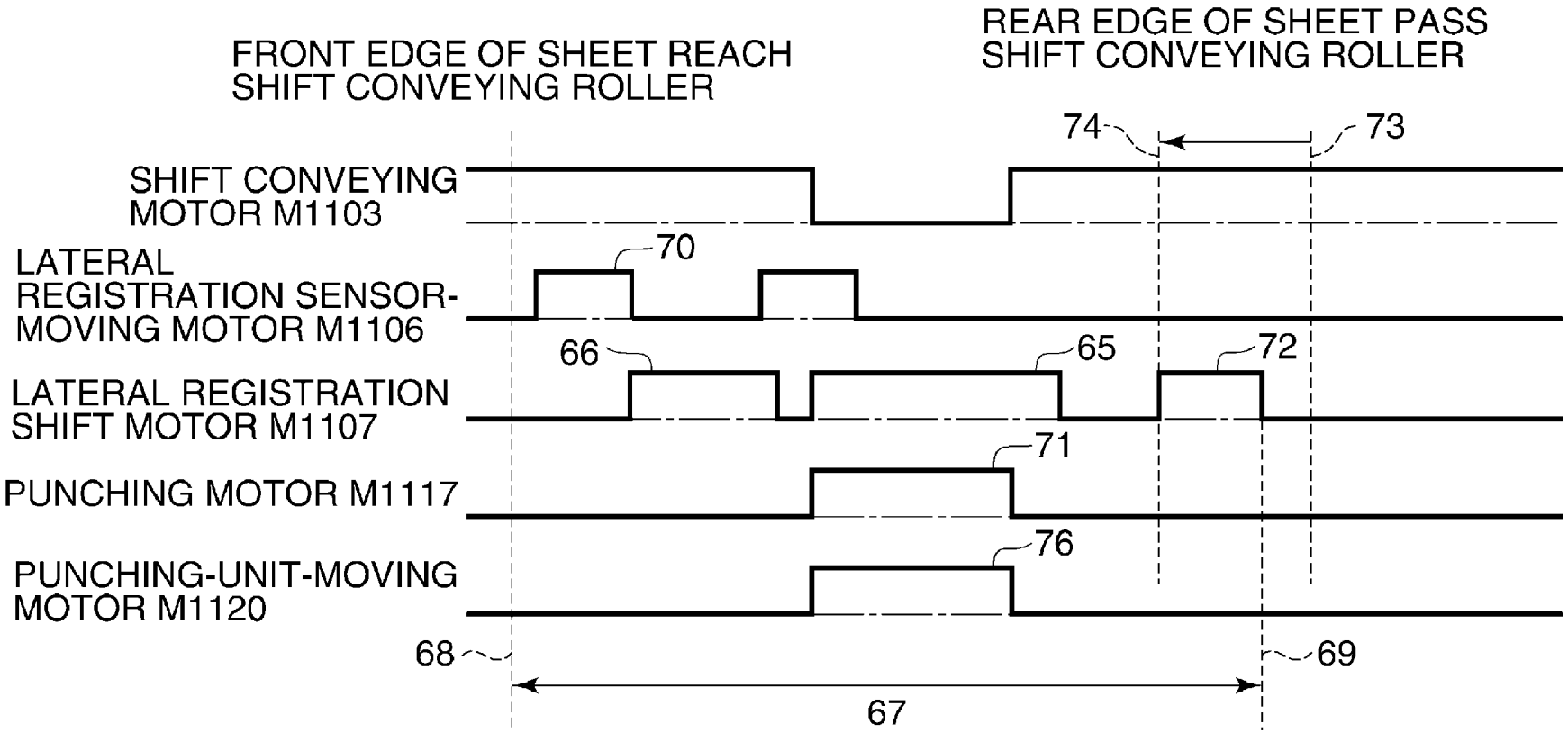
FIG. 9 is a timing chart showing operation timings of the respective units in the punching process in FIG. 6.
Figure 10:
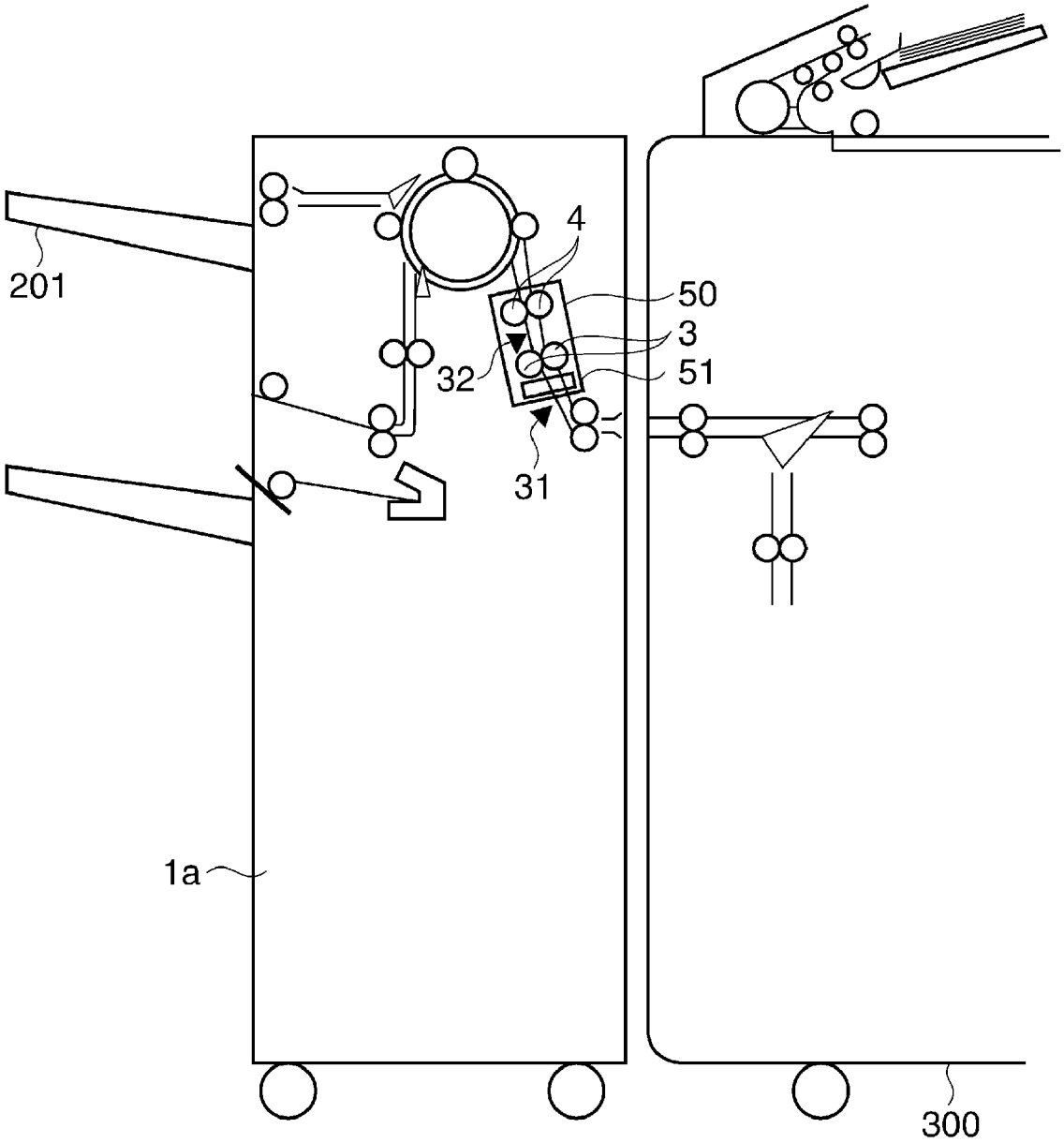
FIG.10 PRIOR ART
FIG. 10 is a sectional view of a conventional sheet processing apparatus.
Figure 11:
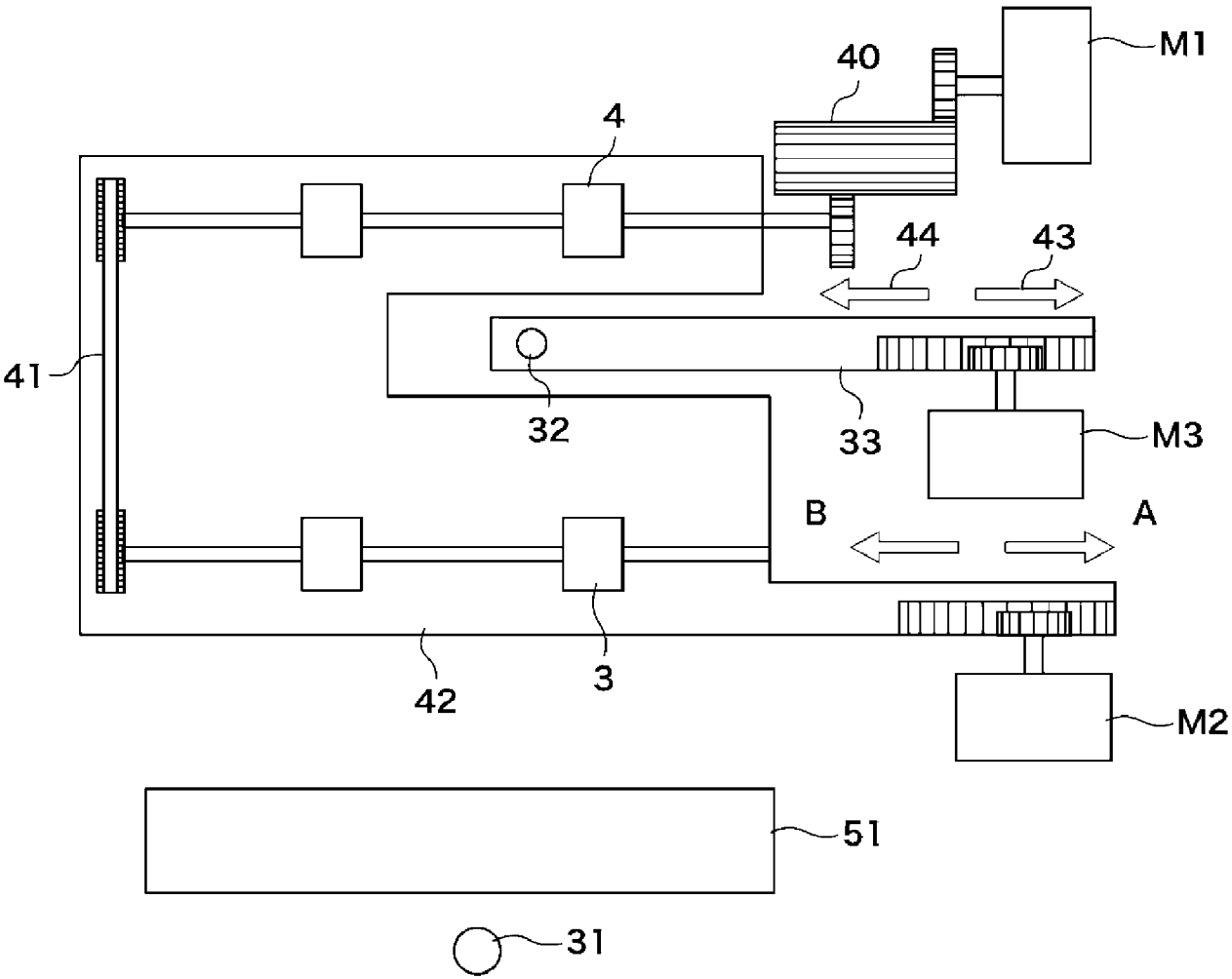
FIG.11 PRIOR ART
FIG. 11 is a schematic view showing a punching device in FIG. 10 when viewed from the right side.
Figure 12:
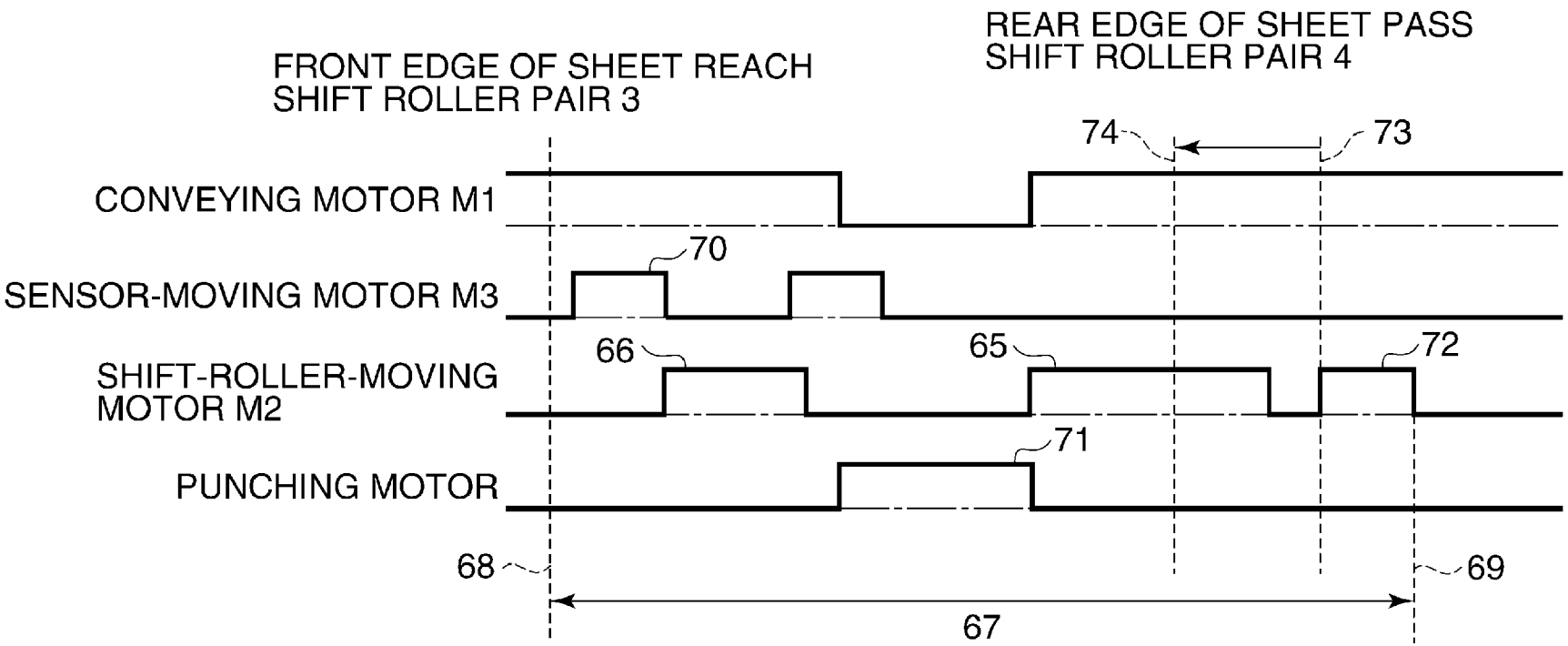
FIG.12 PRIOR ART
FIG. 12 is a timing chart showing a punching operation executed by the punching device included in the sheet processing apparatus in FIG. 10.

FIG. 9 is a timing chart showing the punching process. Time advances to right from left in the figure. FIG. 9 shows driving signals for the shift conveying motor M1103, the lateral-registration-sensor-moving motor M1105, the lateral registration shift motor M1107, the punching motor M1117, and the punching-unit-moving motor M1120, respectively. It should be noted that a high (H) level of each driving signal means that a corresponding motor is under operation, and a low (L) level means that it is not under operation.

In an operating section 70, the lateral-registration-sensor-moving motor M1106 is operated for the lateral registration detection process in the step S103. In an operating section 66, the lateral registration shift motor M1107 is operated for the lateral registration correction process in the step S104. In an operating section 65, the lateral registration shift motor M1107 is operated to execute the sheet ejection offset. In an operating section 71, the punching motor M1117 is operated to execute the punching operation. In an operating section 76, the punching-unit-moving motor M1120 is operated to move the punching unit 750 in synchronization with the sheet ejection offset operation. In an operating section 72, the lateral registration shift motor M1107 is operated to move the lateral registration shift unit 1001 to the standby position.

At a timing 68, the front edge of the sheet reaches the shift conveying roller 1102. At a timing 69, the movement of the lateral registration shift unit 1001 to the standby position for the next sheet is completed. A section 67 shows the punching process time.

At timings 73 and 74, the rear edge of the sheet passes the shift conveying roller 1102. The timing 74 holds for the case where the time until the rear edge of the sheet passes the shift conveying roller 1102 after the front edge of the sheet reaches the shift conveying roller 1102 is shortened.

As mentioned above, since the sheet processing apparatus 500 of this embodiment executes the punching operation (the operating section 71 in FIG. 9) and the sheet ejection offset operation (the operating section 65 in FIG. 9) concurrently, the start timing and the completion timing of the sheet ejection offset can be moved ahead as compared with the case where the sheet ejection offset operation starts after the punching operation. As a result, for example, since the sheet conveying speed after the punching process can be accelerated, the time from the completion of the punching operation to the passage of the rear edge of the sheet over the shift conveying roller 1102 (the timing 74 in FIG. 9) can be shortened, which decreases the punching process time (the section 67 in FIG. 9).

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-253017, filed on Nov. 4, 2009, which is hereby incorporated by reference herein in its entirety.

What is claimed is:

1. A sheet processing apparatus provided with a punching unit, comprising:

a conveying unit configured to convey a sheet;

a first moving unit configured to move the sheet conveyed by said conveying unit in a width direction that crosses a conveying direction of the sheet;

a punching unit configured to punch a hole in the sheet;

a second moving unit configured to move said punching unit in the width direction; and a control unit configured to control said first moving unit so as to change positions of sheets ejected to a sheet stack unit in the width direction by turns for every sheet bundle sorted, and to control said second moving unit and said punching unit so as to execute a punching operation by said punching unit while moving said punching unit in synchronization with the movement of the sheet by said first moving unit.

2. The sheet processing apparatus according to claim 1, wherein said control unit controls said second moving unit so that the movement of said punching unit starts in synchronization with the start of movement of the sheet by said first moving unit.

3. The sheet processing apparatus according to claim 1, wherein after completing the punching operation to the sheet by said punching unit, said control unit controls said second moving unit to move said punching unit to a standby position for executing the punching operation to a next sheet.

4. The sheet processing apparatus according to claim 1, further comprising:

a detection unit configured to detect the position of the sheet conveying in the width direction, wherein said control unit controls said first moving unit to move the sheet so as to correct the sheet position in the width direction based on the detection result of said detection unit.

* * * * *